US007188483B2

(12) United States Patent
Kim

(10) Patent No.: US 7,188,483 B2
(45) Date of Patent: Mar. 13, 2007

(54) EXPANSION VALVE

(75) Inventor: Hahkkyu Kim, Daejeon-si (KR)

(73) Assignee: Halla Climate Control Corporation, Daejeon-si (KR)

( * ) Notice: Subject to any disclaimer, the term of this patent is extended or adjusted under 35 U.S.C. 154(b) by 277 days.

(21) Appl. No.: 10/782,819

(22) Filed: Feb. 23, 2004

(65) Prior Publication Data

US 2004/0163399 A1 Aug. 26, 2004

(30) Foreign Application Priority Data

Feb. 24, 2003 (KR) ..... 10-2003-0011457
Aug. 25, 2003 (KR) ..... 10-2003-0058836

(51) Int. Cl.
*F25B 41/04* (2006.01)
*G05D 27/00* (2006.01)
*F25B 1/00* (2006.01)

(52) U.S. Cl. ..... 62/222; 236/92 B

(58) Field of Classification Search ..... 62/222, 62/226, 227; 236/92 B, 92 R; 251/129.15
See application file for complete search history.

(56) References Cited

FOREIGN PATENT DOCUMENTS

JP 08159617 A * 6/1996
JP 2001-241808 9/2001

* cited by examiner

*Primary Examiner*—Chen-Wen Jiang
(74) *Attorney, Agent, or Firm*—Nixon Peabody LLP; Jeffrey L. Costellia

(57) ABSTRACT

This invention relates to an expansion valve, which has rectangular flow channels for assembling inlet and outlet pipes of an evaporator with an inlet pipe of a compressor and an outlet pipe of a condenser at an approximate right angle, and a guide part formed on the flow channel, thereby improving a mounting efficiency and reducing flow resistance and noise, and the expansion valve includes a body having at least one or more flow channels, each of which has inlets and outlets whose central lines are at a right angle to each other, and a guide part formed between the inlet and the outlet; a head part mounted on the body and reciprocating a rod in an axial direction by expansion and contraction actions according to a temperature change of the working fluid discharged from an outlet of an evaporator and flowing through the flow channel; and opening means for controlling a flow amount of the working fluid flowing through the flow channel according to the movement of the rod.

3 Claims, 9 Drawing Sheets

EXPANSION VALVE

BACKGROUND OF THE INVENTION

1. Field of the Invention

The present invention relates to an expansion valve, and more particularly, to an expansion valve, which has rectangular flow channels for assembling inlet and outlet pipes of an evaporator with an inlet pipe of a compressor and an outlet pipe of a condenser at an approximate right angle, and a guide part formed on the flow channel, thereby improving a mounting efficiency and reducing flow resistance and noise.

2. Background of the Related Art

In general, as shown in FIG. 1, a cooling system compresses working fluid, which performs thermal exchange with the outdoor air, into a liquefiable gas state of high temperature and pressure inside a compressor 1, and transmits it to a condenser 20.

The working fluid of the gas state is changed into a liquid state while passing the condenser 20 and induced to an expansion valve 30.

After that, the working fluid changed into a liquid state is changed into a wet-saturated vapor state of low temperature and pressure by a throttling action of the expansion valve 30, and induced to an evaporator 40 mounted inside an air conditioning case 50.

Next, the working fluid induced to the evaporator 40 is evaporated of itself by absorbing heat (latent evaporation heat), which is necessary for evaporation, from the surrounding air, and repeatedly performs the above cycle by being induced into the compressor 10 after being changed into a gas state.

Components of the above cooling system are installed at predetermined positions inside an engine room 61 and a passenger room 62 of a car respectively.

That is, the air conditioning case 50 is installed in the passenger room 62 divided by a dash panel 60, and other components are installed inside the engine room 61.

During the above circulation process of the working fluid, the working fluid of the inside of the evaporator 40 absorbs the outdoor air heat passing the outside of the evaporator 40 and thermally exchanges the outdoor air into a low temperature state, so that the inside of a car room can be cooled continuously.

However, when working fluid of a small amount and a highly thermal load is induced into the evaporator 40, as the working fluid is completely evaporated before reaching an outlet of the evaporator 40 and discharged to the compressor 10 in an overheated condition, it deteriorates a cooling efficiency and overheats the compressor 10. On the contrary, when working fluid of an excessive amount is induced into the evaporator 40 and a degree of superheat is too low, as a part of the working fluid remains at the outlet of the evaporator 40 in a liquid state and is induced into the compressor 10, it causes a damage of the compressor 10.

Therefore, the expansion valve 30 is installed between the condenser 20 and the evaporator 40 and expands the condensed working fluid to evaporate the working fluid in the evaporator 40, so that the working fluid can be evaporated in the evaporator 40 while maintaining a proper degree of superheat.

Hereinafter, for your convenience, a flow channel of the expansion valve 30 connected with an inlet pipe 41 of the evaporator 40 is named as a first flow channel 32, and a flow channel connected with an outlet pipe 42 of the evaporator 40 is named as a second flow channel 33.

FIG. 2 is a sectional view of the expansion valve. In brief, the expansion valve includes: a body 31 having the first flow channel 32, which has an inlet 32*a* and an outlet 32*b* of the same flow direction, and the second flow channel 33, which has an inlet 33*a* and an outlet 33*b* of the same flow direction, the first and second flow channel 32 and 33 being separated from each other at a predetermined interval; a head part 34 mounted on the upper portion of the body 31 and having a temperature-sensing room 34*a* filled with fluid, and a diaphragm 34*b* and a plate 34*c* displaced in the upward direction according to expansion and contraction of the fluid; a rod 35 disposed on the lower portion of the plate 34*c* and having an end portion extending to the first flow channel 32 through the second flow cannel 33, the rod 35 performing an axial reciprocating motion according to a displacement amount of the diaphragm 34*b* and the plate 34*c*; an elastic member 36 mounted on the first flow channel 32 to apply elasticity toward the rod 35; and a ball 37 disposed between the end portion of the rod 35 and the elastic member 36 for controlling a sectional area of the first flow channel 32.

The above conventional expansion valve 30 is installed on the outer surface or the inner surface of the air conditioning case 50. If the expansion valve 30 is installed on the outer surface of the air conditioning case 50, it can be installed on one of both sides of the dash panel 60 of the car body. That is, the expansion valve 30 can be installed in the passenger room 62 or the engine room 61 of the car.

Hereinafter, an example for installing the expansion valve 30 into the engine room 61 of the car will be described.

FIG. 3 is a briefly exploded perspective view showing a state in which the conventional expansion valve is installed in the engine room. In FIG. 3, the inlet pipe 41 and the outlet pipe 42 of the evaporator 40 passing the dash panel 60 are assembled to a first flange 70, connected to sides of the first and second flow channels 32 and 33 of the expansion valve 30, and then, coupled with screw holes 38 formed in a side of the expansion valve 30 by bolts 72.

Ends of pipes 11 and 21 respectively connected to an inlet side of the compressor 10 and to an outlet side of the condenser 20 are assembled to a second flange 71, connected to the other sides of the first flow channels 32 and 33 of the expansion valve 30, and then, coupled with the screw holes 38 of the expansion valve 30 by the bolts 72.

By the above structure, when an amount of the working fluid induced into the evaporator 40 is small, an outlet part of the evaporator 40 is overheated more than a set temperature due to a rapid thermal exchange, the temperature-sensing room 34*a* sensing the overheated temperature is expanded, the diaphragm 34*b* moves the rods in an axial direction, and the ball 37 interlocking with the rod 35 opens the first flow channel 32 more than before.

Therefore, the working fluid of an amount more than before is supplied to the evaporator 40 through the opened first flow channel 32, and then, evaporated by the thermal exchange with the outdoor air while maintaining the proper degree of superheat.

Meanwhile, when an amount of the working fluid induced into the evaporator 40 is large, a part of the working fluid remains in the outlet portion of the evaporator 40 in a liquid state to lower the temperature less than the set temperature, and thereby, the temperature-sensing room 34*a* sensing the low temperature is contracted, and at the same time, the elastic member 36 is moved in an opposite direction to the direction of the case that the rod 35 is expanded. So, the ball 37 interlocking with the elastic member 36 opens the first flow channel 32 less than before.

Therefore, the working fluid supplied to the evaporator 40 through the first flow channel 32 performs the thermal exchange with the outdoor air while maintaining the proper degree of superheat.

However, when the expansion valve 30 and the first and second flanges 70 and 71 are assembled to each other in the engine room 61 of a small area, if they are assembled to each other in a row, the pipes 11 and 21 connected with the second flange 71 greatly protrude toward the engine room 61, and so, it is difficult to install the expansion valve 30 due to restriction in an assembling space.

To solve the above problem, as shown in FIG. 4, a connection block 80, which has right-angled holes 81, is inserted between the first flange 70 and the expansion valve 30 to assemble the first flange 70 and the expansion valve 30 at a right angle.

That is, when the first flange 70 and the expansion valve 30 are assembled to each other at a right angle by the connection block 80, also the second flange 71 connected to the other side of the expansion valve 30 can be assembled at a right angle to the first flange 70.

Therefore, the pipes 11 and 21 assembled to the second flange 71 do not protrude toward the engine room 61, and are installed nearly along the dash panel 60, so that the restriction in the assembling space is reduced when assembling work is performed inside the engine room 61.

However, as the pipes 11, 21, 41 and 42 are connected at a right angle to reduce the restriction in the assembling space, the connection block 80 is needed additionally, it is inconvenient to assemble the components due to the assembling work in the small engine room 61, and productivity is lowered due to increase of manufacturing costs and the number of assembling processes as the number of necessary components is increased.

To solve the above problems, JP Patent Publication No. 2001-241808 discloses an expansion valve. In brief, as shown in FIG. 5, the expansion valve has a square pillar type valve body 90. The valve body 90 includes an inflow channel 91 directing from the evaporator to the compressor and an outflow channel 92 directing from the compressor to the evaporator, and the inflow channel 91 and the outflow channel 92 are formed on a rectangular side of the valve body 90.

Therefore, the above expansion valve increases a degree of freedom in installation of the expansion valve, and allows an easy alignment of the evaporator and the compressor inside the engine room.

However, in the prior art, as an inlet 91*a* and an outlet 91*b* for the working fluid are formed in the rectangular side to increase the degree of freedom in installation, the flow channel 91 for passing the working fluid is formed at a right angle, and so, it may cause increase of flow resistance and noise due to a sudden change of fluid flow.

SUMMARY OF THE INVENTION

Accordingly, the present invention is directed to an expansion valve that substantially obviates one or more problems due to limitations and disadvantages of the related art. An object of the present invention is to provide an expansion valve, which has a flow channel formed at a right angle and a guide part formed on the flow channel for guiding a fluid flow, thereby improving a mounting efficiency and reducing flow resistance and noise.

To achieve these objects and other advantages and in accordance with the purpose of the invention, as embodied and broadly described herein, the expansion valve comprises: a body having at least one or more flow channels, each of which has an inlet and an outlet whose central lines are at a right angle to each other, and a guide part 114*a* formed on an intersection between the inlet and the outlet for guiding the flow of working fluid; a head part mounted on the body and reciprocating a rod in an axial direction by expansion and contraction actions according to a temperature change of the working fluid discharged from an outlet of an evaporator and flowing through the flow channel; and opening means for controlling a flow amount of the working fluid flowing through the flow channel according to the movement of the rod.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
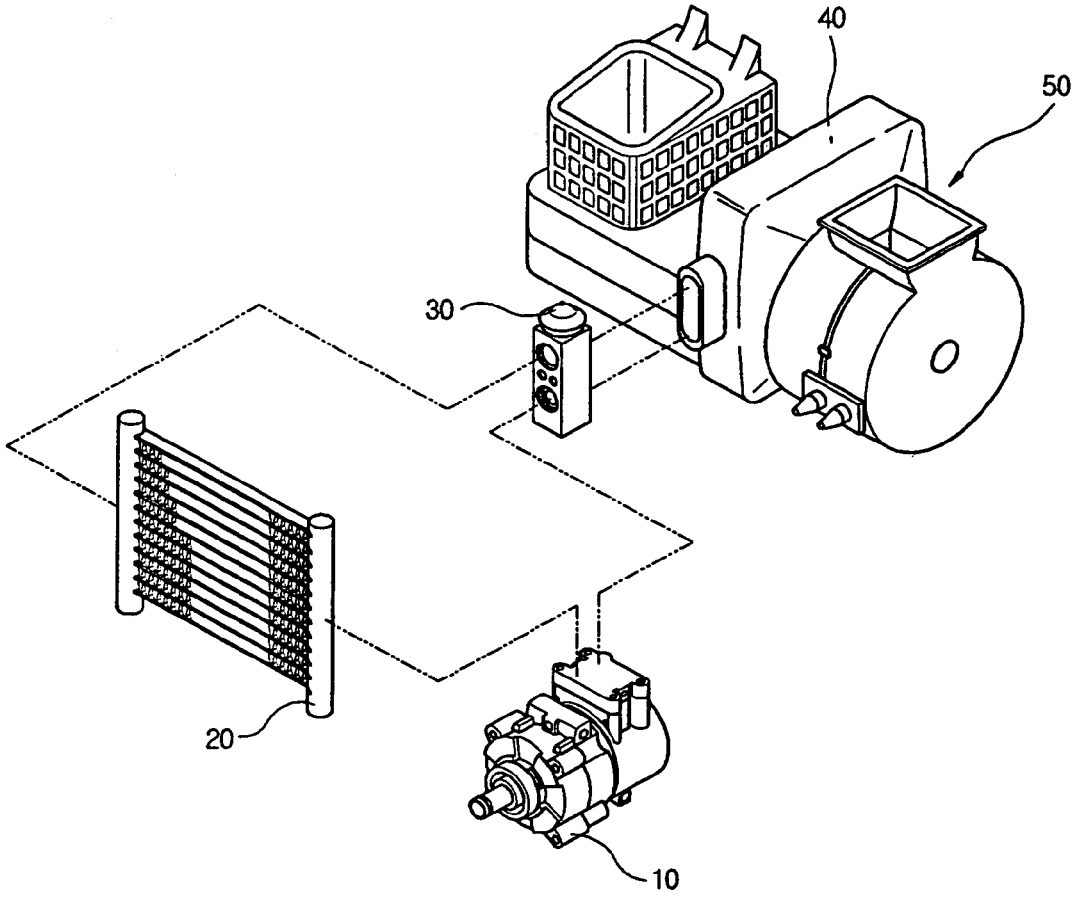
Figure 1 PRIOR ART
FIG. 1 is a brief structural view of a conventional cooling system for a car.
Figure 2:
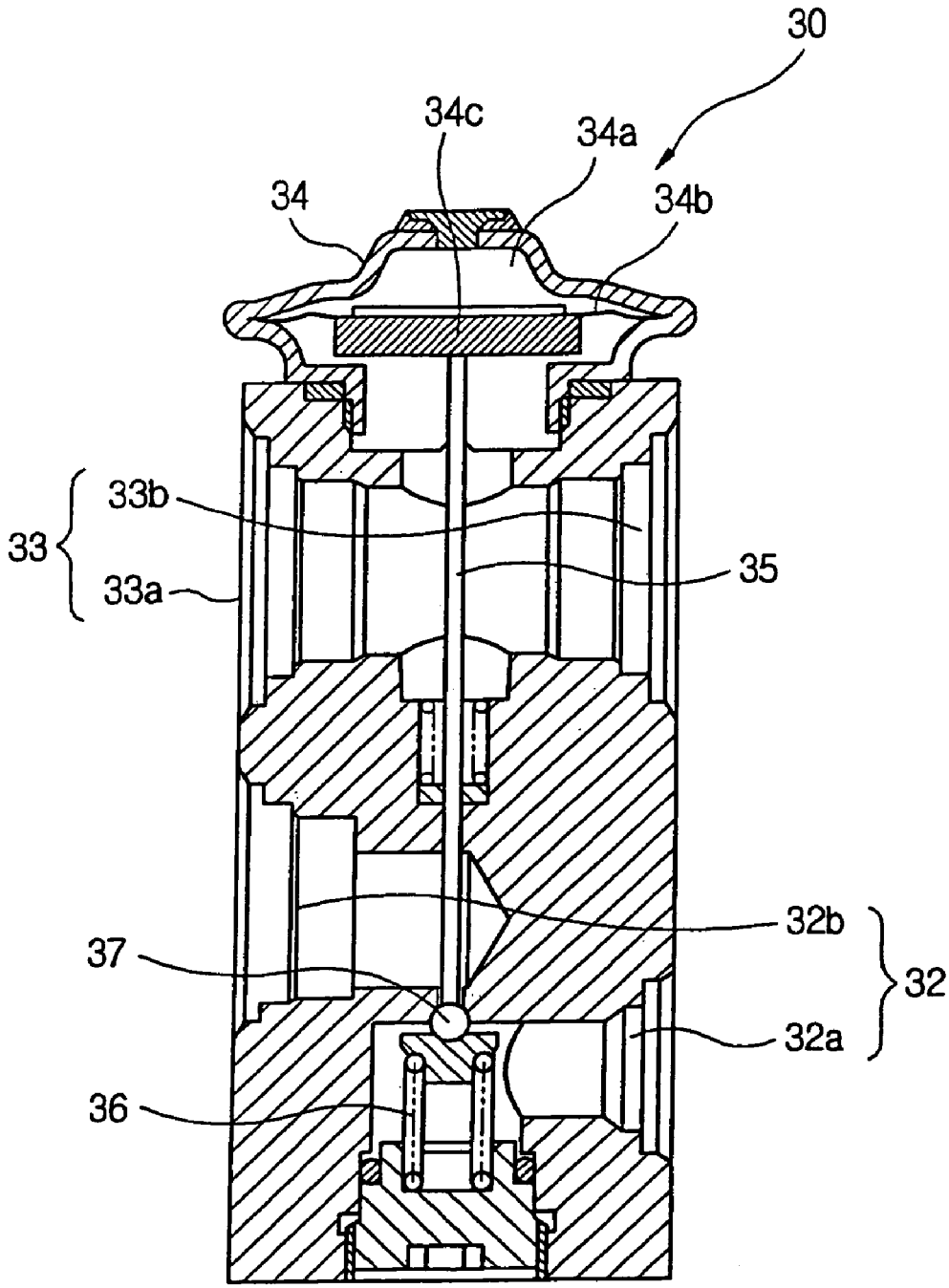
Figure 2 PRIOR ART
FIG. 2 is a sectional view of a conventional expansion valve.
Figure 3:
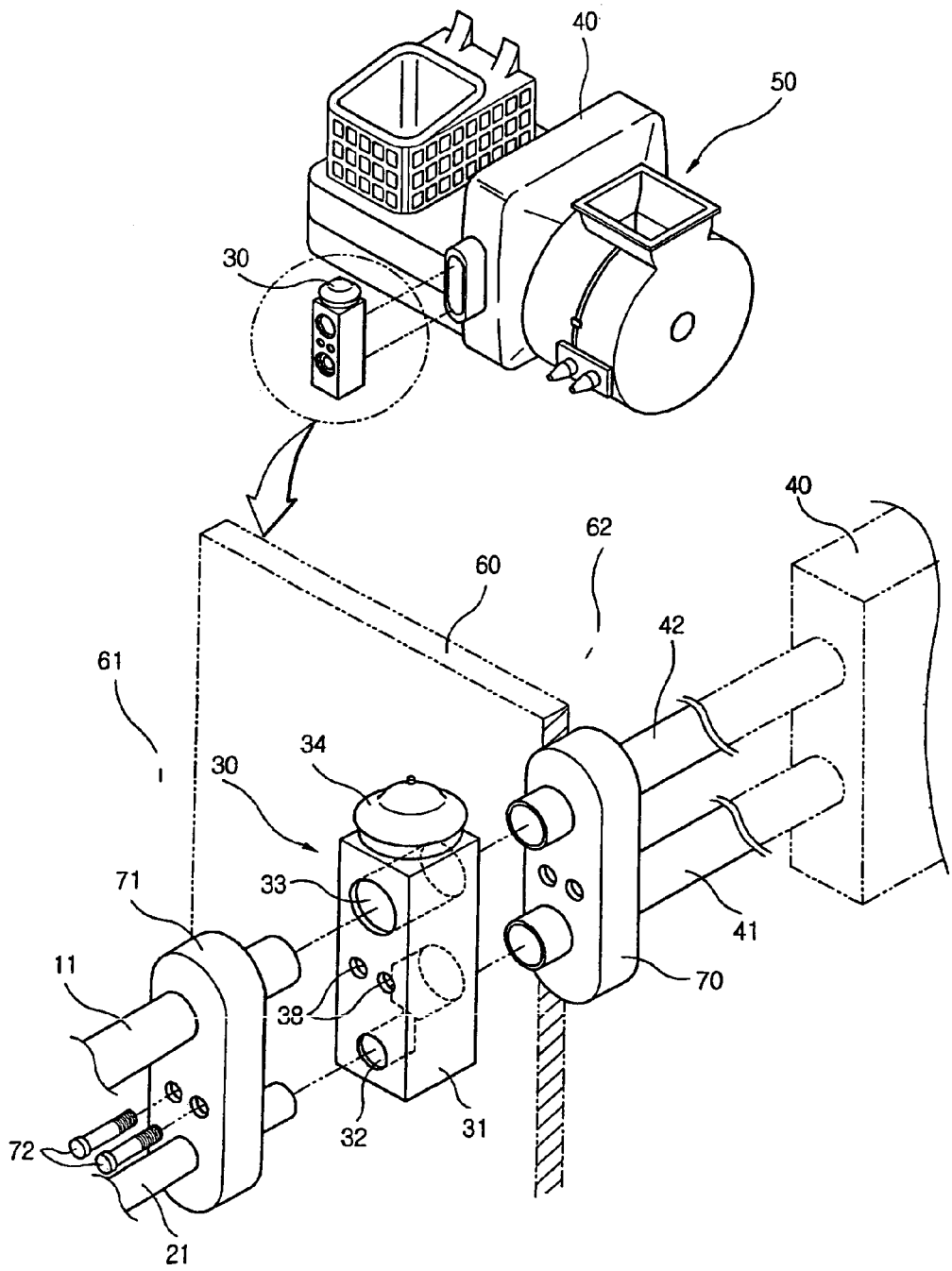
Figure 3 PRIOR ART
FIG. 3 is a brief exploded perspective view showing a state in which the conventional expansion valve is installed in an engine room.
Figure 4:
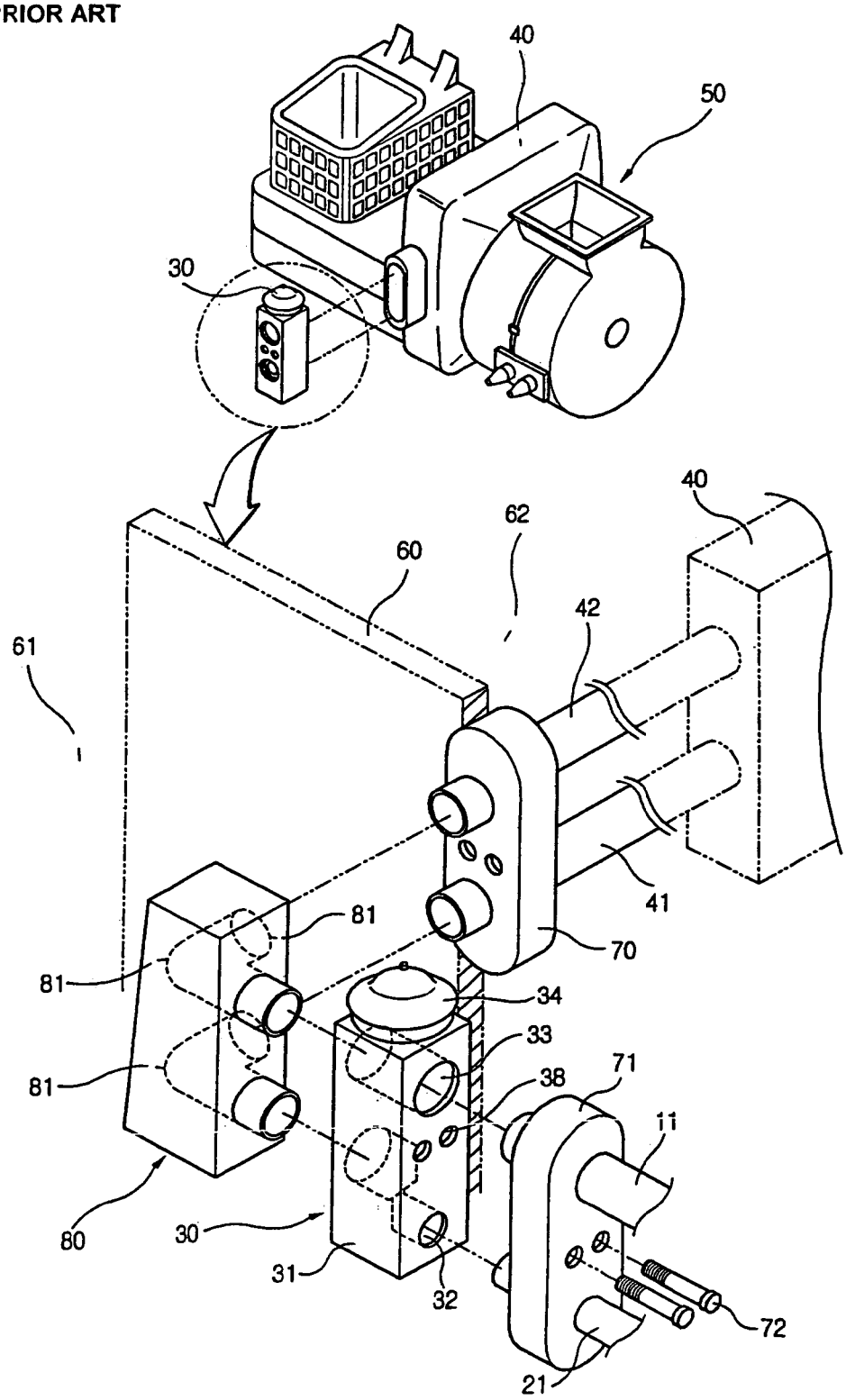
Figure 4 PRIOR ART
FIG. 4 is a brief exploded perspective view showing another example of a state in which the conventional expansion valve is installed in an engine room.
Figure 5:
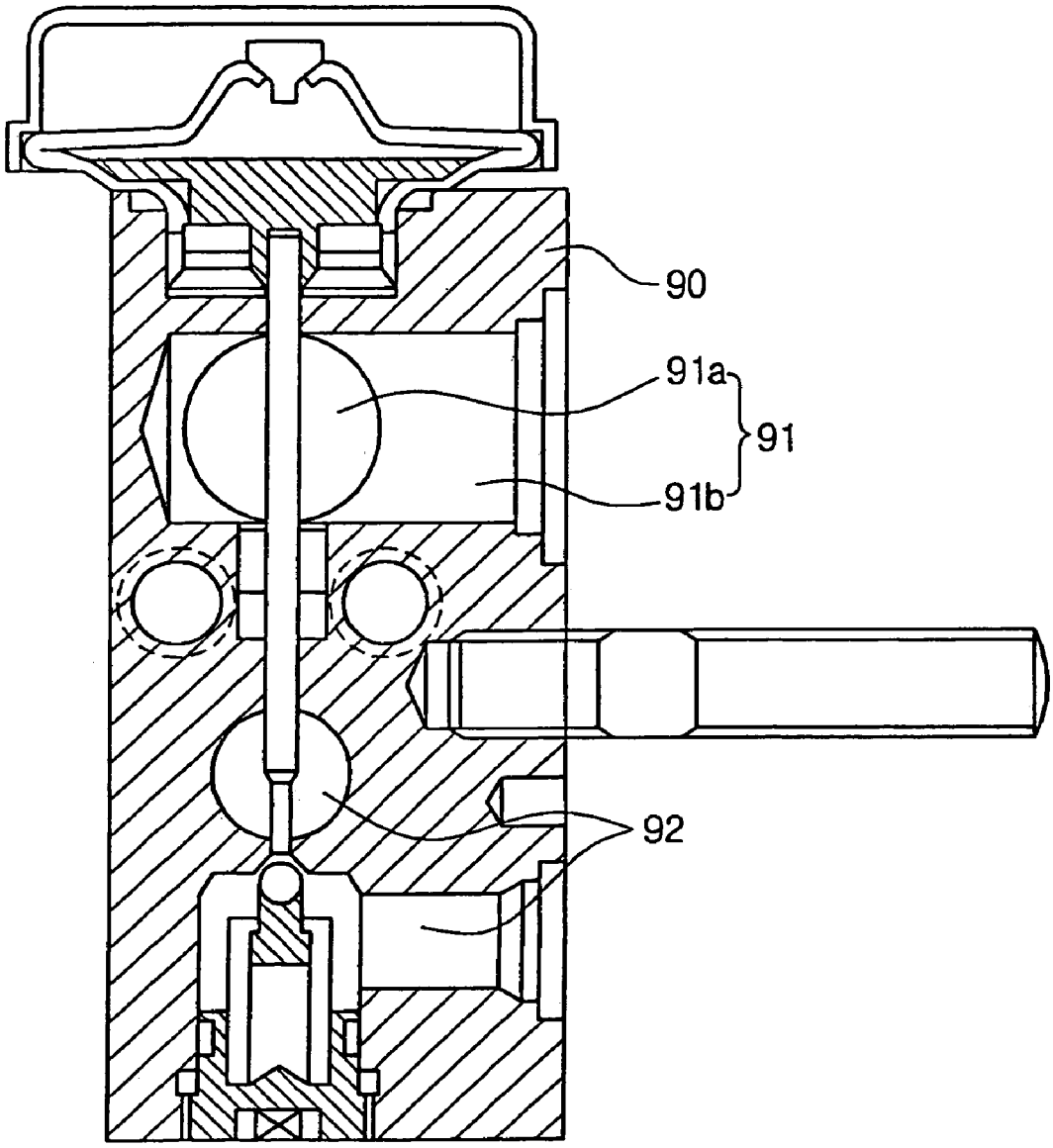
Figure 5 PRIOR ART
FIG. 5 is a sectional view of another conventional expansion valve.

Reference will now be made in detail to the preferred embodiments of the present invention, examples of which are illustrated in the accompanying drawings.

The same parts as the convention expansion valve have the same reference numerals, and repeated description of the same parts will be omitted.

Figure 6:
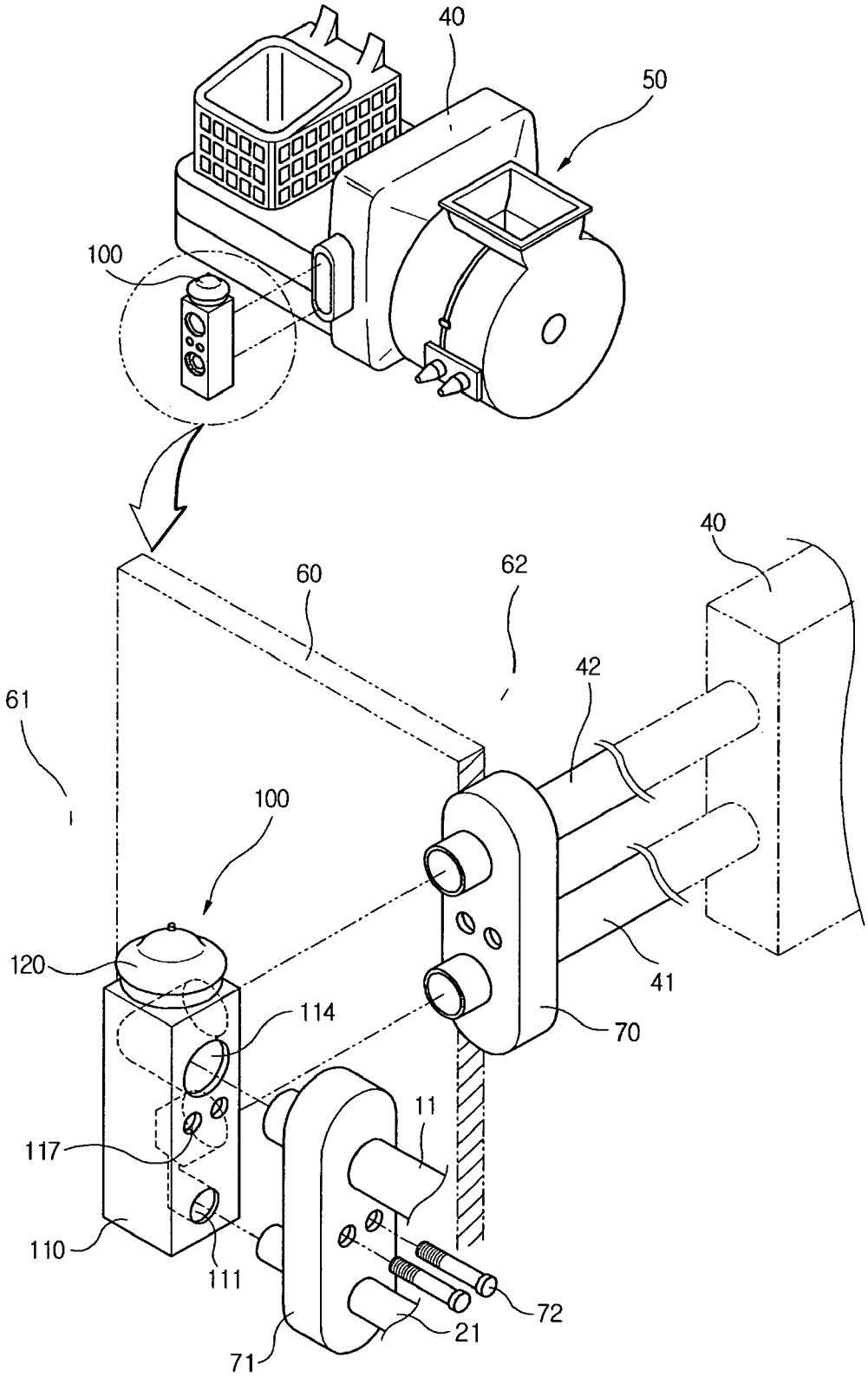
FIG. 6 is a brief exploded perspective view showing a state in which an expansion valve according to a first preferred embodiment of the present invention is installed in an engine room.
Figure 7:
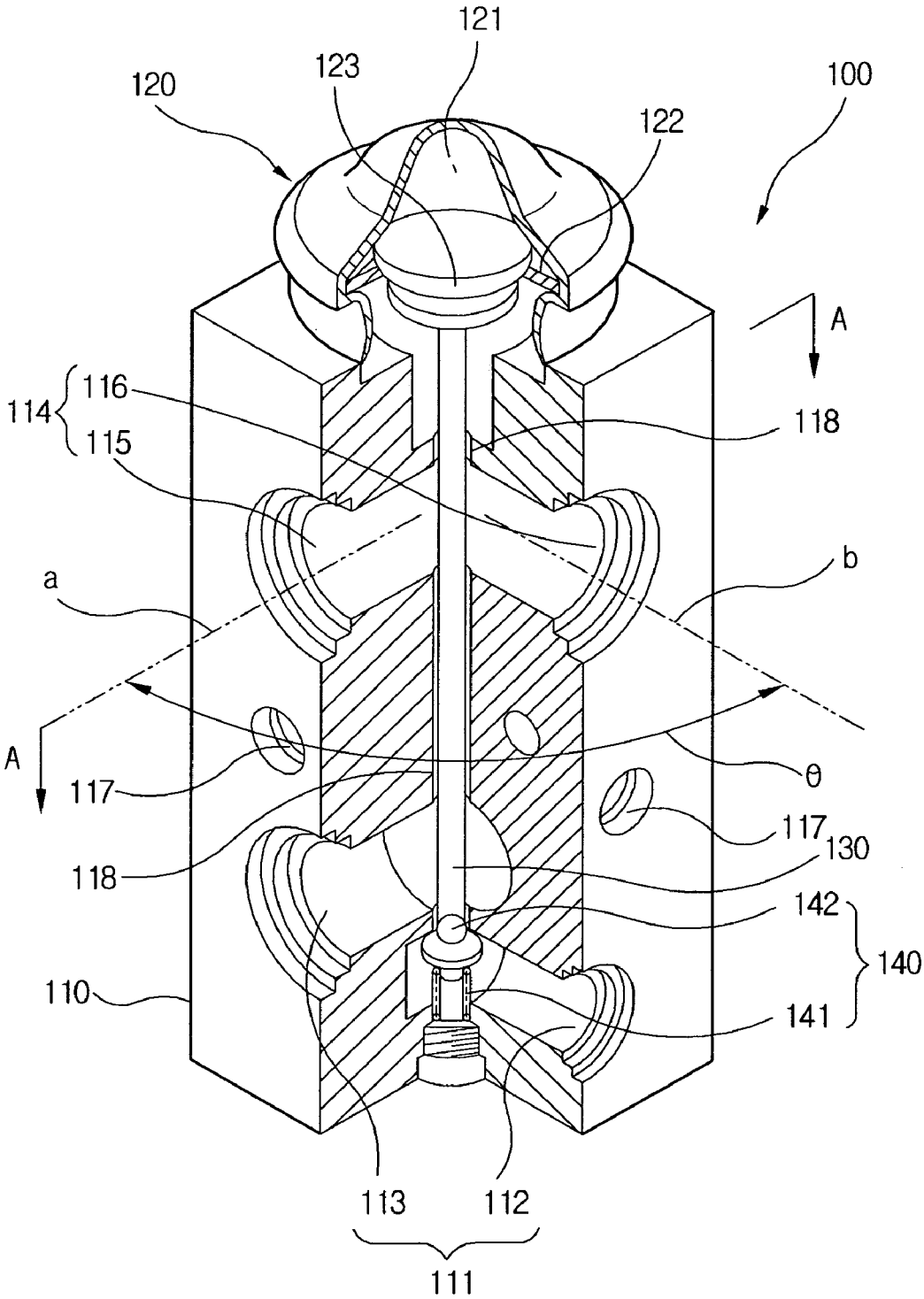
FIG. 7 is a perspective view, in a partial section, showing the expansion valve according to the first preferred embodiment of the present invention.
Figure 8:
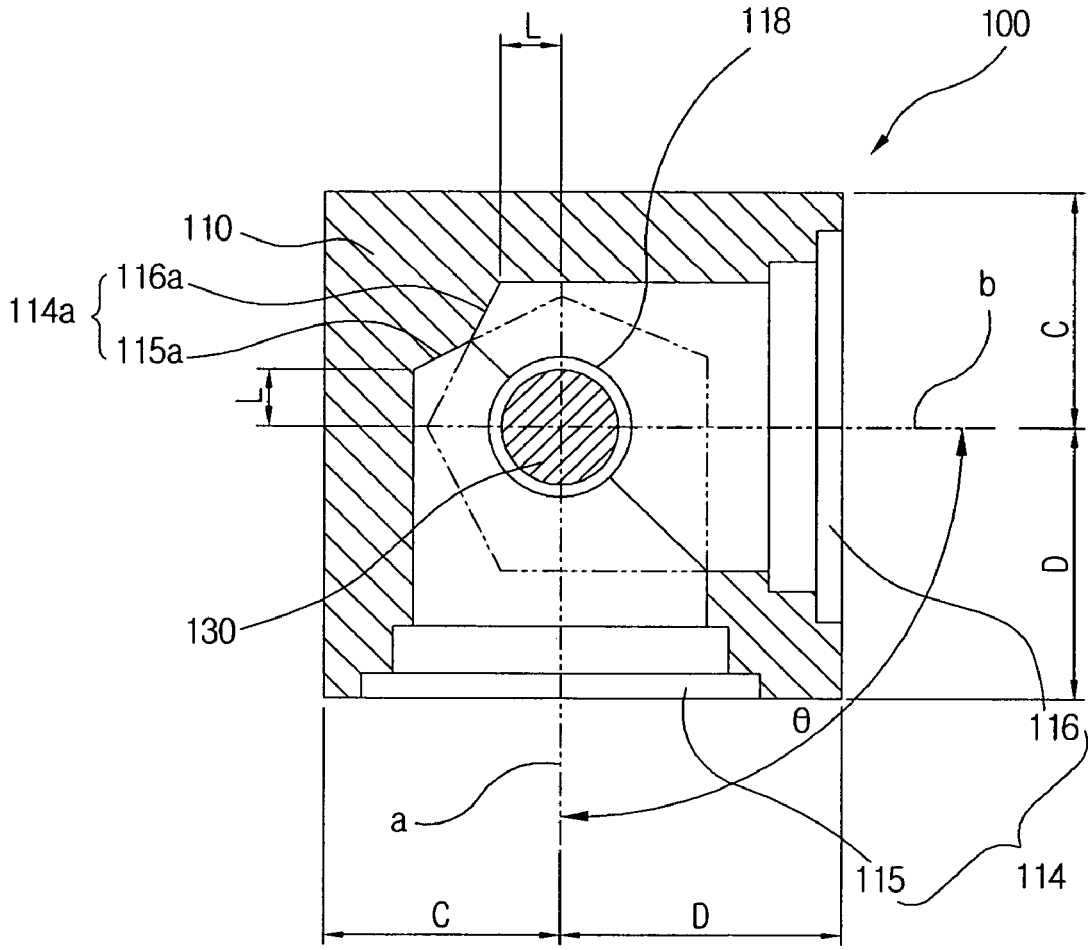
FIG. 8 is a sectional view taken by the line of A-A of FIG. 7.

FIG. 6 is a brief exploded perspective view showing a state in which an expansion valve according to a first preferred embodiment of the present invention is installed in an engine room, FIG. 7 is a perspective view, in a partial section, showing the expansion valve, and FIG. 8 is a sectional view taken by the line of A—A of FIG. 7.

As shown in the drawings, the expansion valve 100 according to the present invention includes: a body 110 having a first flow channel 111 and a second flow channel 114 separated from each other at a predetermined interval, the first flow channel 111 having an inlet 112 and an outlet 113 whose central lines a and b are at an approximate right angle to each other, the second flow channel 114 having an inlet 115 and an outlet 116 whose central lines a and b are at a right angle to each other; a head part 120 mounted on the upper portion of the body 110 and reciprocating a rod 130 in an axial direction by expansion and contraction actions due to a temperature change of working fluid discharged from an evaporator 40 and flowing through the second flow channel 114; and an opening means 140 interlocking with the rod 130 for controlling a flow amount of fluid flowing through the first flow channel 111 connected with an inlet part of the evaporator 40.

The head part 120 includes: a temperature-sensing room 121 filled with the fluid expanding and contracting according to the temperature change of the working fluid discharged from the outlet of the evaporator 40; a diaphragm 122 disposed inside the temperature-sensing room 121 and displaced vertically according to the expansion and contraction of the fluid; and a plate 123 connected to the center of the diaphragm 122.

The rod 130 reciprocating axially according to a vertical displacement of the plate 123 is slidably mounted into a through hole 118, which extends from the temperature-sensing room 121 to the first flow channel 111 through the second flow channel 114.

The opening means 140 is mounted at the lower end of the rod 130 on the first flow channel 111. The opening means 140 includes an elastic member 141 having elasticity to always contact the rod 130 with the plate 123 of the temperature-sensing room 121, and a ball 142 disposed between an end portion of the rod 130 and the elastic member 141 for controlling a sectional area of the first flow channel 111.

The expansion valve 100 can change the angle θ between the central lines a of the inlets 112 and 115 and the central lines b of the outlets 113 and 116 of the first and second flow channels 111 and 114 according to a sectional shape of the body 100, an installation location of the expansion valve 100, and peripheral components arranged in a passenger room 62 or the engine room 61.

Here, it is preferable that the angle θ is about 90°.

That is, sides of the first and second rectangular flow channels 111 and 114 are connected with a first flange 70 assembled with inlet and outlet pipes 41 and 42 of the evaporator 40, and the other sides thereof are connected with a second flange 71 assembled with an inlet pipe 11 of a compressor 10 and an outlet pipe 21 of a condenser 20. After that, the first and second flow channels 111 and 114 are at a right angle after the inlet and outlet pipes 41 and 42 of the evaporator 40 are assembled with the inlet pipe 11 of the compressor 10 and the outlet pipe 21 of the condenser 20.

The first and second flanges 70 and 71 are fixed to screw holes 117 formed in the expansion valve 100 by bolts 72.

Therefore, the expansion valve 100 is installed by passing the dash panel 60, and assembled with the first flange 70 connected with the inlet and outlet pipes 41 and 42 of the evaporator 40, and then, the second flange 71 is assembled to the expansion valve 100 at a right angle, so that the inlet and outlet pipes 11 and 21 of the compressor 10 and the condenser 20 are installed nearly along the dash panel 60.

The angle θ, which is a right angle (90°) made between the central lines a of the inlets 112 and 115 of the first and second flow channels 111 and 114 and the central lines b of the outlets 113 and 116, is the optimum value for reducing the restriction in an assembling space when the expansion valve 100 is installed inside the engine room 61, and also is to apply the function and effect of the conventional connection block 80 for connecting the pipes 11, 21, 41 and 42 at a right angle with one another without using the conventional connection block 80.

Meanwhile, a guide part 114*a* is formed on an intersection between the inlet 115 and the outlet 116 for guiding the flow of the working fluid.

The guide part 114*a* includes inclined surfaces 115*a* and 116*a* respectively formed on the inlet 115 and the outlet 116. It is preferable that the guide part 114*a* is formed on the second flow channel 114 communicating with the outlet pipe 42. That is, it is preferable that the guide part 114*a* is formed on the second flow channel 114 where refrigerant flows from the evaporator 40 to the compressor 10.

Here, the guide part 114*a* is formed when the inlet 115 and the outlet 116 is drilled for forming the second flow channel 114, namely, formed by intersection of the inclined surface 115*a* of the inlet 115 and the inclined surface 116*a* of the outlet 116, which are formed by an angle of the end blade of a drill.

Therefore, the inclined surfaces 115*a* and 116*a* have the same shape as the end blade of the drill forming the inlet 115 and the outlet 116.

Furthermore, it is preferable that a length L between start portions of the inclined surfaces 115*a* and 116*a* and the center of the through hole 118 of the body 110, through which the rod 130 passes, satisfies the following formula:

$$0 \leqq L \leqq 4.5 \text{ mm.}$$

Of course, the above length L can be changed according to diameters and locations of the inlet 115 and the outlet 116, and at this time, it is preferable that end portions of the inlet 115 and the outlet 116 are not out of the outer diameter of other intersecting hole.

Therefore, as the guide part 114*a* prevents a sudden bending of the intersection portion between the inlet 115 and the outlet 116, an eddy is not generated during the flow of the working fluid, the working fluid flows smoothly inside the second flow channel 114, and noise generated when-a path area is widened is prevented due to reduction of the path area at the intersection portion.

Here, it is preferable that the length L made when the guide part 114*a* is formed is within a range of 0~4.5 mm, but it is not restricted to the above range. However, if the length L is out of the above range, the above effects may be reduced.

Meanwhile, it is preferable that the inlets 112 and 115 and the outlets 113 and 116 formed in the body 110 are formed eccentrically from the body 110 to reduce elements.

In FIG. 8, distances from the central lines a and b of the inlet 115 and the outlet 116 to both ends of the body 110 are "c" and "d", and at this time, the distances satisfies c<D. By the above formula, elements of parts of the body 110 where the inlet 115 and the outlet 116 are not formed can be reduced.

Figure 9:
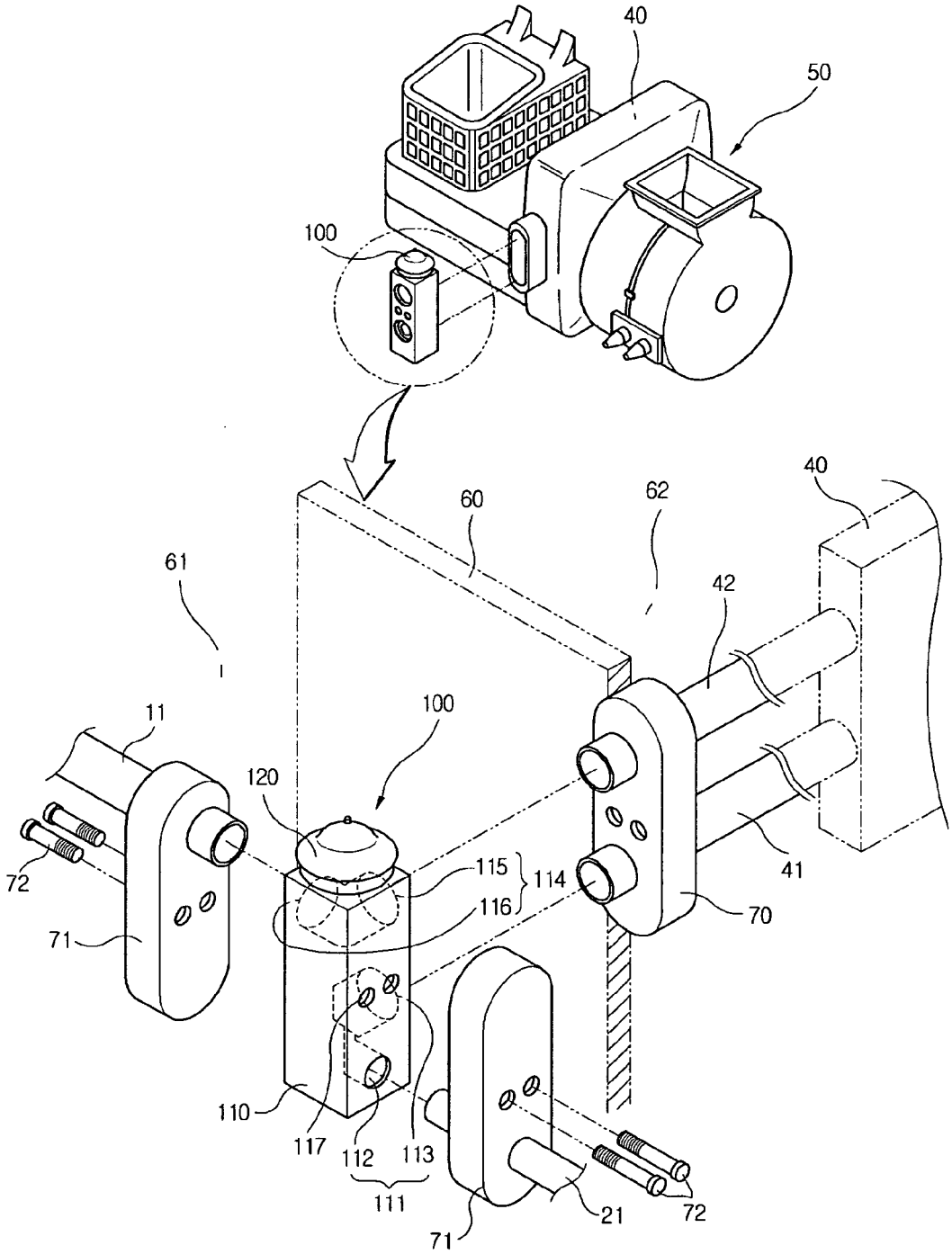
FIG. 9 is a brief exploded perspective view showing a state in which an expansion valve according to a second preferred embodiment of the present invention is installed in an engine room.

FIG. 9 is a brief exploded perspective view showing a state in which an expansion valve according to a second preferred embodiment of the present invention is installed in the engine room. In the second preferred embodiment, only different parts from the first preferred embodiment will be described, and the same description as the first preferred embodiment will be omitted.

As shown in the drawing, the inlet 112 of the first flow channel 111 and the outlet 116 of the second flow channel are formed in the opposite directions to each other.

That is, the inlet pipe 11 of the compressor 10 and the outlet pipe 21 of the condenser 20 are assembled in the opposite directions from the expansion valve 100.

The above is an example of the expansion valve 100 modified according to the installation location of the compressor 10 and the condenser 20 and the peripheral components arranged inside the engine room 61.

Continuously, a forming method of the flow channel 114 formed in the expansion valve 100 will be described as follows.

Here, the flow channel 114 is the second flow channel formed by the intersection of the inlet 115 and the outlet 116 at a right angle.

The forming method of the second flow channel 114 includes: the first drilling process of forming the inlet 115 thereof; and the second drilling process of forming the outlet 116 in the body 110 to provide the central line b being at an approximate right angle to the central line a of the inlet 115 and of forming the guide part 114*a* on the intersection with the inlet 115 for guiding the flow of the working fluid.

Here, it does not matter to form the outlet 116 during the first drilling process and to form the inlet 115 during the second drilling process.

The guide part 114*a* is made by the intersection of the inclined surfaces 115*a* and 116*a* formed by the angle of the end blade of the drill when the inlet 115 and the outlet 116 are formed.

That is, the inclined surfaces 115*a* and 116*a* can be intersected to each other by adjusting depths of the inlet 115 and the outlet 116 formed by the first and second drilling processes, and the guide part 114*a* can be varied in size.

At this time, it is preferable that the depth of the inlet 115 and the outlet 116 must satisfy the range, i.e., $0 \leqq L \leqq 4.5$ mm, between the start portions of the inclined surfaces 115*a* and 116*a* and the center of the through hole 118 of the body 110.

As described above, the expansion valve 100 according to the present invention has the inlets 112 and 115 and the outlets 113 and 116 of the first and second rectangular flow channels 111 and 114 of the body 110, and the guide part 114*a* formed on the intersection of the inlet 115 and the outlet 116 for guiding the flow of the working fluid, so that the inlet and outlet pipes 41 and 42 of the evaporator 40 are assembled with the inlet pipe of the compressor 10 and the outlet pipe 21 of the condenser 20 at a right angle by the medium of the first and second flanges 70 and 71.

Therefore, the pipes 11 and 21 do not protrude toward the engine room 61 and go round in the rectangular direction so as to reduce the restriction in the assembling space when the expansion valve 100 is assembled in the engine room 61.

Moreover, the present invention can reduce manufacturing costs by reducing the number of components such as the conventional connection block 80, and improve productivity by reducing the number of the assembling processes.

In addition, as the guide part 114*a* prevents the working fluid flowing through the second flow channel 114 from being sudden bended at the intersection portion between the inlet 115 and the outlet 116 and guides the flow of the working fluid along the guide part 114*a*, the working fluid flows smoothly and the noise is reduced.

As described above, in the above embodiments of the present invention, the expansion valve 100 is installed in the engine room 61 is described, but may be installed in the passenger room 62, or on the outer surface or the inner surface of an air conditioning case 50.

According to the present invention, the inlets and the outlets of the first and second flow channels of the body of the expansion valve are at a right angle to each other, and the guide part is formed at the intersection portion between the inlet and the outlet for guiding the flow of the working fluid, so that the expansion valve according to the present invention can improve a mounting efficiency and reduce flow resistance and noise.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An expansion valve comprising:

a body having at least one or more flow channels, each of which has inlets and outlets whose central lines are at an approximate right angle to each other, and a guide part formed on an intersection between the inlet and the outlet for guiding the flow of working fluid;

a head part mounted on the body and reciprocating a rod in an axial direction by expansion and contraction actions according to a temperature change of the working fluid discharged from an outlet of an evaporator and flowing through the flow channel; and opening means for controlling a flow amount of the working fluid flowing through the flow channel according to the movement of the rod, wherein the guide part includes inclined surfaces formed on the inlet and the outlet, respectively, and a length between start portions of the inclined surfaces of the inlet and the outlet and the center of a through hole of the body through which the rod goes satisfies the following formula: $0 \leqq L \leqq 45$ mm.

2. The expansion valve according to claim 1, wherein the guide part is formed on the flow channel communicating with the outlet side of the evaporator.

3. The expansion valve according to claim 1, wherein the inlets and the outlets are formed eccentrically from the body.

* * * * *